United States Patent [19]

Holtorf

[11] 4,099,613

[45] Jul. 11, 1978

[54] DISPLAY AND TRANSPORTATION CASE FOR UNIFORM PACKS

[75] Inventor: Ehrhard T. Holtorf, Dudenhofen, Germany

[73] Assignee: Ferrero GmbH, Frankfurt am Main, Germany

[21] Appl. No.: 634,105

[22] Filed: Nov. 21, 1975

[30] Foreign Application Priority Data

Nov. 21, 1974 [DE] Fed. Rep. of Germany ... 7438874[U]

[51] Int. Cl.[2] ..... B65D 65/16

[52] U.S. Cl. ..... 206/45.34; 206/326; 206/45.33; 206/459

[58] Field of Search ..... 206/326, 45.33, 45.34, 206/459

[56] References Cited

U.S. PATENT DOCUMENTS

| | | | |
|---|---|---|---|
| 1,188,825 | 6/1916 | Potter | 206/326 |
| 2,331,753 | 10/1943 | Wohlers | 206/326 |
| 2,745,588 | 5/1956 | Dunning | 229/17 B |
| 3,858,717 | 1/1975 | Peters | 206/459 |
| 3,870,221 | 3/1975 | Zeitter | 206/45.34 |

*Primary Examiner*—William Price
*Assistant Examiner*—Douglas B. Farrow
*Attorney, Agent, or Firm*—Sughrue, Rothwell, Mion, Zinn and Macpeak

[57] ABSTRACT

A display container for a plurality of uniform, stacked wafer packs 3 having L-shaped opposite side walls 6, 11 and 7, 12, a front wall 5, a rear wall 10, and bottom walls 4, 9. The upper ends of the container are open to facilitate the stacking and removal of the packs, and the containers are dimensioned such that two of them mate in an inverted manner to form a rectangular solid for efficient transportation.

17 Claims, 5 Drawing Figures

FIG. 3
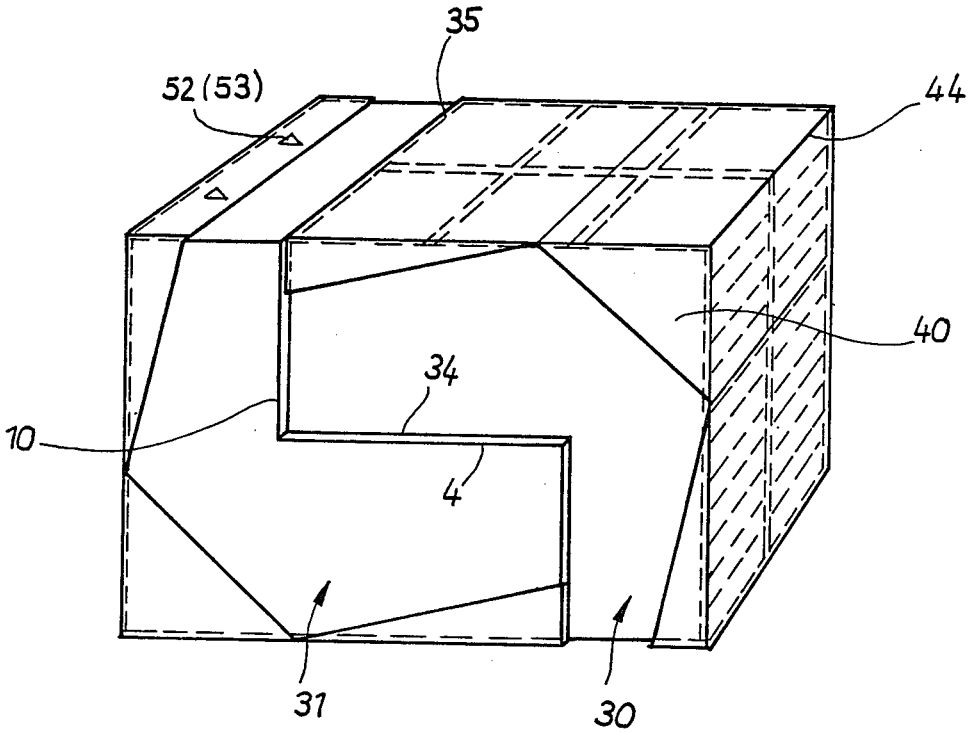
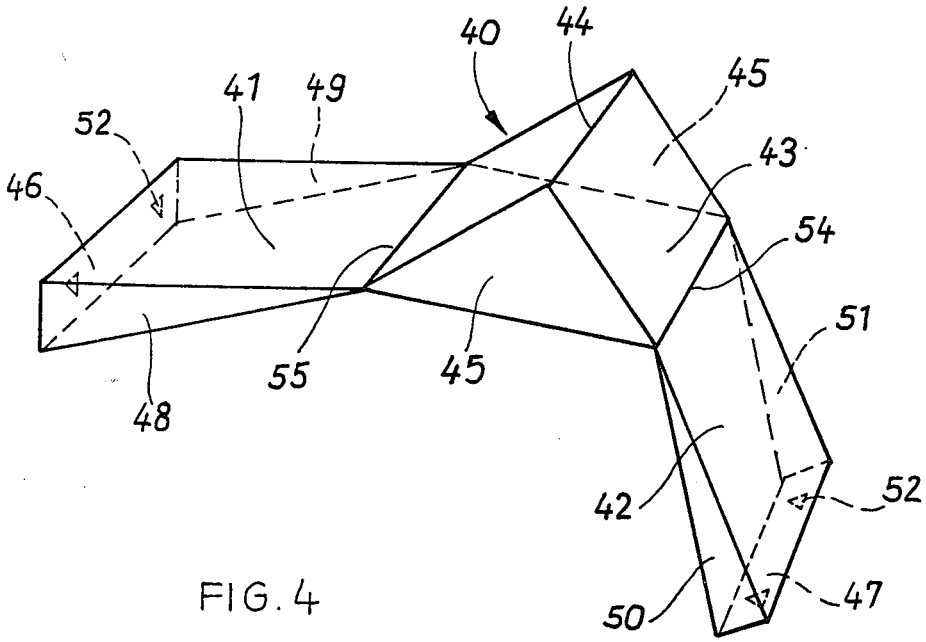
FIG. 4

DISPLAY AND TRANSPORTATION CASE FOR UNIFORM PACKS

BACKGROUND OF THE INVENTION

1. Field of the Invention

The present invention relates to a display and transportation case for uniform, laminar packs which are rectangular in plan view and square in cross-section, more particularly, wafer packs comprising at least a front face, a bottom face and two side walls.

2. Description of the Prior Art

Numerous forms of containers for holding packs are already known. For example, a display stand is known which consist of two V-shaped, interconnected foldable parts, wherein each part of the container is used to hold packets of pralines and thus in the case of this display stand the goods which are offered for sale, i.e., the packets of pralines, are available on two sides. However, a pack comprising this type of display stand in a case is relatively bulky; furthermore, after removal of the display stand from the case it is still necessary to use various handles to set up the display stand for retail purposes. A recurrent problem for self-service or discount stores, in particular, is that of providing suitable display stands which can be converted from the transportable position to the display position with very little difficulty.

SUMMARY OF THE INVENTION

The object of the present invention is to produce a display and transportation case of suitable construction which takes up very little space in the transporting position and is especially attractive in the display position.

This problem is solved in the case of a display and transporting container of the type described initially in that according to the invention the container consists of two sections disposed at right angles to one another and designed to hold the packs in a stacked arrangement; the bottom wall of the first section is disposed at right angles to the rear wall of the second section and the fold between the bottom wall and front wall of the first section and the fold between the rear wall and front wall of the second section serve as bearing edges in the display position. For transportation purposes two containers can be placed together in a symmetrical manner to form a square.

The length and/or thickness of the two sections can vary; the length of the first section may be a multiple of the height of a single pack and the length of the second section a multiple of the thickness of a pack. Both sections can be appropriately designed and dimensioned for holding uniformly directed packs in stack form; the length of the first section is advantageously three times the length of a pack and the length of the second section 12 times the thickness of a pack. It is also possible for the depth of the first section to be six times the thickness of a pack and the depth of the second section the length of a single pack.

The upper sides of the two sections can be open; the two upper sides can advantageously be covered by a rectangular, transparent part comprising on its two transverse sides a stiffened edge piece partially enclosing the corresponding pack wall. According to a preferred embodiment the transparent part comprises on its edge sections, lugs, projections or the like which are directed towards the inside of the container and which engage in corresponding recesses of the pack. The transparent part can also be reinforced at the knee point by lateral flaps or tongues; the lateral tongues can be triangular in shape and similarly formed tongues can also be provided on both the longitudinal sides of the transparent part.

Another feature of the invention consists in that the portion of the transparent part covered by the triangular reinforcements corresponds to a multiple of the length and/or thickness of a pack. The reinforced portion at the knee point of the transparent part may be separated from the remaining part thereof by a fold extending at right angles to the container.

It is also possible for the container to be constructed in a known manner of a single blank; the wall parts can be formed by doubling the blank and can be joined together by mutual engagement in the operational position.

BRIEF DESCRIPTION OF THE DRAWINGS

FIG. 3 is an oblique view of two containers which have been placed together in the transporting position.

FIG. 4 is a cover for a container according to the invention, more particularly, for transportation purposes.

DESCRIPTION OF THE PREFERRED EMBODIMENT

Figure 1:
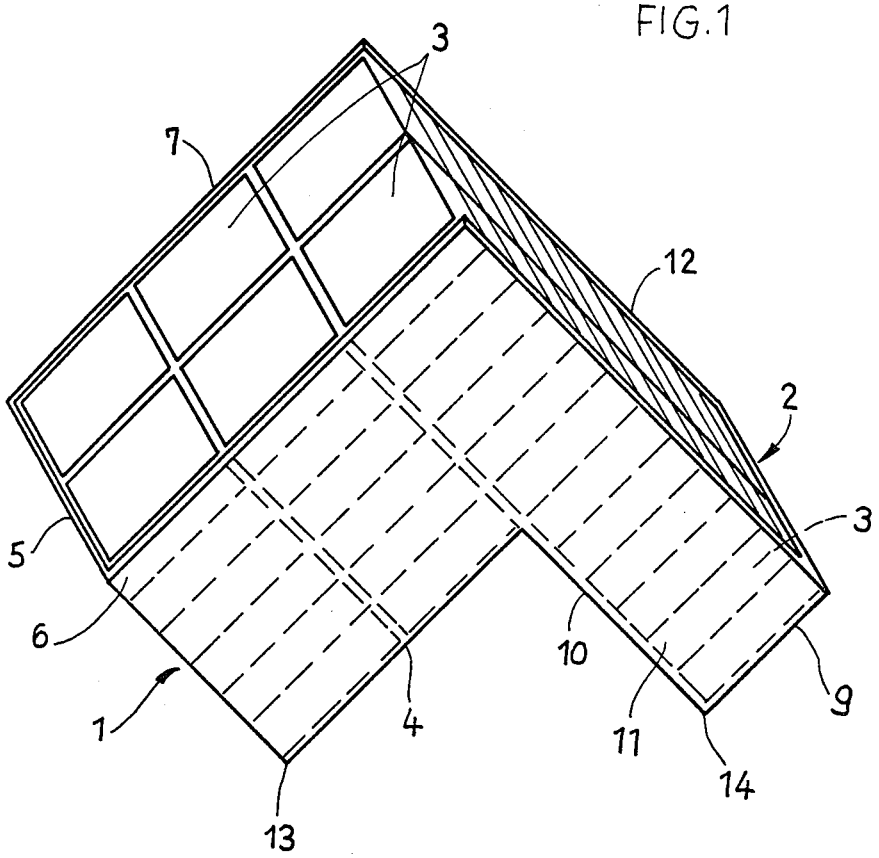
FIG. 1 is an oblique view of the display and transportation case according to the invention.

A container consisting of two sections 1 and 2 is L-shaped and is used to hold square wafer packs 3. These square wafer packs 3 are inserted in the first section 1 in four adjacent stacks each containing six packs, and the second section 2 holds two adjacent stacks each containing 12 packs.

As will be noted, the upper surfaces of the six stacks are flush with one another.

According to this embodiment the first section comprises a virtually square cross-section. The first section comprises a bottom wall 4 which is not shown in greater detail, a front wall 5 and two side walls 6 and 7. As represented, the first section changes straight into the second section without any transition zone; the width of the second section 2 corresponds to double the width of a square wafer pack 3.

The length of the free shank of the second section 2 corresponds to the thickness of six wafer packs 3 stacked one above the other. The embodiments show that the two shanks of the display and transportation case according to the invention are not only of differing length, but are also of differing thickness. Accordingly, the second section 2 comprises a bottom wall 9, a rear wall 10 and side walls 11 and 12. As will be noted, the walls 6 and 7 change into the walls 11 and 12 of the other section in a jointless manner.

The fold 13 between the bottom wall 4 and the front wall 5 of the first section 1 forms one bearing surface of the display case, and the fold 14 between the rear wall 10 and the bottom wall 9 of the second section 2 forms a second bearing surface.

Figure 2:
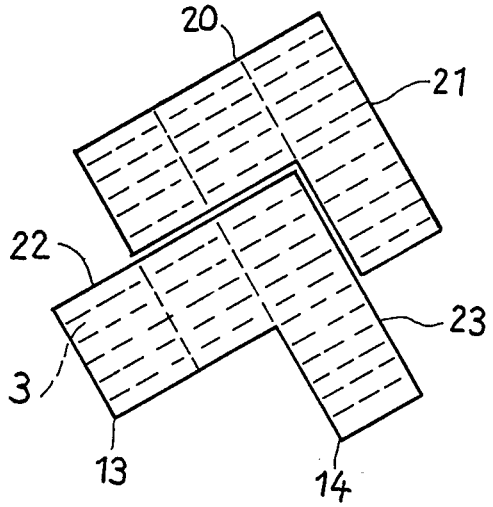
FIG. 2 is a side view of two containers according to the invention disposed one on the other.

The special configuration of the display and transportation case ensures that the individual containers can easily be mounted one on the other for display and retail purposes; this is represented by way of example in FIG. 2 in which one container is placed on the other.

The containers are placed one on top of the other in such a way that it is not only possible to remove articles from the upper sides 20 or 21 of the upper pack but a part of the upper sides 22 or 23 of the lower container also displays the articles. In the embodiment represented, two adjacent packs 3 in the lefthand section of the lower container are not gripped by the container mounted thereabove but are free.

An asymmetrical L shape is particularly suitable for transporting containers of this type. FIG. 3 shows the transporting position; a container 30 is placed on another container 31 in such a way that the bottom walls 4 and 34 of the two containers are disposed adjacent to one another and the rear wall 10 of the container 31 contacts the front wall 35 of the other container. As a result, an extremely compact square is obtained which is very manageable from the point of view of packing. The two containers which are joined together, for example, by means of adhesive strips, take up the least amount of space and can still be converted into the display position represented in FIG. 2 without having to make any substantial changes.

A transparent part 40, which is represented in further detail in FIG. 4, is mounted on the two upper sides of the two sections of the case for the purpose of securing the stacks of packs in the two containers — particularly during transportation thereof.

The transparent part, which may be produced from synthetic foil by the deep drawing process, comprises relatively well reinforced wall parts. It comprises the edge sections 41 and 42 and a central section 43. The central section 43 comprises a knee 44 which corresponds to the corresponding knee in the container. The two sides of the central section 43 are connected together by triangular reinforcing parts 45, thereby forming a relatively rigid spatial triangle.

Relatively rigid spatial triangles are also formed in the two edge sections 41, 42. Tongues 46 or 47 are attached to the transverse sides of the transparent part and extend at right angles thereto and the tongues 46 and 47 are, in turn, connected to the upper side of the transparent part by triangular reinforcing parts 48 – 51. The two tongues 46 and 47 comprise lugs 52 which are directed towards the knee 44 and which engage in corresponding openings 53 in the container wall in the operational position.

The cover, which consists of the transparent part, is mounted over the two upper sides as represented in FIG. 3. A corresponding transparent cover is obviously provided for the second container 31.

It should also be noted that the respective sections are separated from one another by folds 54 and 55, thereby enabling a part of the transparent cover to be folded without difficulty and also enabling the cover to be removed from the container without difficulty.

Figure 5:
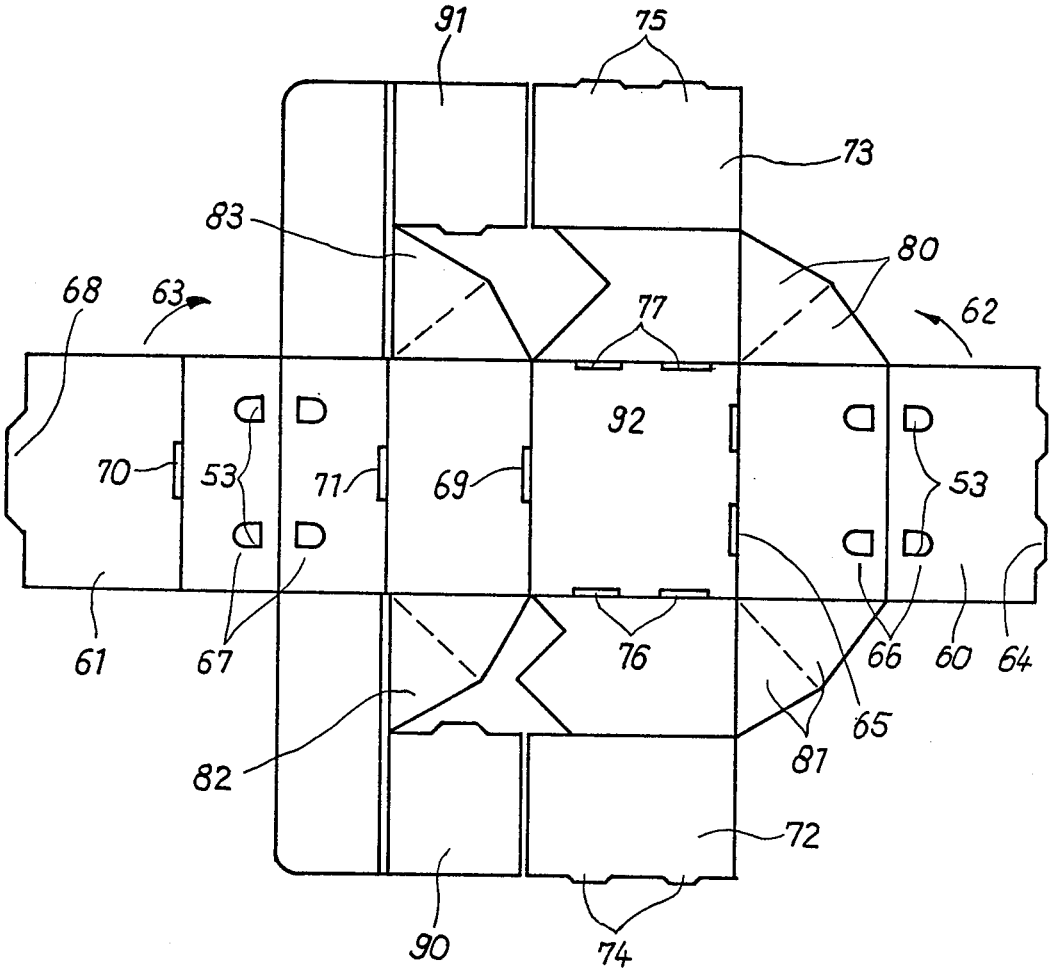
FIG. 5 is a plan view of a blank suitable for producing a case according to FIG. 1.

FIG. 5 shows a blank which can be used for producing a container according to FIGS. 1 – 3.

The container shown in FIG. 1 is produced in the following manner: the two tongues 60 and 61 are folded as indicated by the arrows 62, 63 and the projections 64 on the tongues 60 are inserted in the slots 65, and the projection 68 on the tongue 61 is inserted in the slot 69 thereby forming double wall parts 66,67. Additionally, the projection 70 engages in the slot 71.

Thereafter, the tongues 72 and 73 are folded in a similar manner to form double wall parts, and their projections 74 and 75 are inserted in the slots 76 and 77.

It should also be noted that the respective connecting tongues 80, 81, 82 and 83, which each comprise a fold, are inserted between the doubled tongues prior to the above mentioned connecting operation, thus producing an open box-shaped container having a right-angled oblong form.

The tongues 90 and 91 are then folded in the drawing plane and inserted between the double wall parts in such a way that the fold 92 forms the fold between the bottom wall 4 (see FIG. 1) and the rear wall 10.

All the parts which are connected together are doubled and are thus reinforced.

The container-which is open on both sides of its upper side-can now be filled with the above-mentioned packs 3. After inserting the packs, the transparent parts 40 are placed on the two upper sides of the sections and held in place by the "insertion" of the lugs 52 in the openings 53.

What is claimed is:

1. A display and transportation container for a plurality of uniform wafer packs (3) each having a solid rectangular configuration, characterized in that the container is L-shaped and comprises two contiguous sections (1, 2) disposed at right angles to one another and designed to hold the packs in a plurality of adjacent stacks, in that the bottom wall (4) of the first section is disposed at a right angle to the rear wall (10) of the second section, in that the fold (13) between the bottom wall (4) and the front wall (5) of the first section and the fold (14) between the rear wall (10) and the bottom wall (9) of the second section are parallel to each other and serve as bearing edges in the display position, in that the upper ends of the two sections and the front side of the second section are fully open to implement complete access to the entire areas thereof, in that the interior of the container is fully open to implement the unhindered stacking of the packs, and in that for transportation purposes, two containers can be placed together in a symmetrical, mating manner to form a rectangle, and whereby the packs may be removed from the top of the stacks when in said display position.

2. A display and transportation container as claimed in claim 1, characterized in that the lengths of the two sections are unequal.

3. A display and transportation container as claimed in claim 2, characterized in that the length of the first section corresponds to a multiple of the length of a pack and the length of the second section corresponds to a multiple of the thickness of a pack.

4. A display and transportation container as claimed in claim 3, characterized in that the length of the first section is three times the length of a pack and the length of the second section is twelve times the thickness of a pack.

5. A display and transportation container as claimed in claim 4, characterized in that the depth of the first section is six times the thickness of a pack and the depth of the second section corresponds to the length of a pack.

6. A display and transportation case as claimed in claim 1, or the following claims, characterized in that the upper sides of the two sections are open.

7. A display and transportation container as claimed in claim 1, characterized in that the two upper ends can be covered with a right-angled transparent part for transportation purposes, said transparent part comprising on its two transverse sides a reinforced edge part partially enclosing the corresponding pack wall.

8. A display and transportation container as claimed in claim 7, characterized in that the transparent part comprises on its edge portions lugs, projections, or the like, which project towards the inside of the container and which engage in corresponding recesses in the pack in the operational position.

9. A display and transportation container as claimed in claim 7, wherein said transparent part includes a knee and is reinforced with lateral tongues or flaps at the knee.

10. A display and transportation container as claimed in claim 9, characterized in that the lateral tongues or flaps are triangular in shape and are similarly provided on the two longitudinal sides of the transparent part.

11. A display and transportation container as claimed in claim 10, characterized in that the portion of the transparent part covered by the triangular reinforcements corresponds to a multiple of the length and/or thickness of a pack.

12. A display and transportation container as claimed in claim 11, characterized in that the reinforced section at the knee part of the transparent cover is separated from the remaining part thereof by a fold extending at right angles to the container.

13. A display and transportation container as claimed in claim 10 or the following claims, characterized in that the container is produced in a known manner from a single blank, the wall parts are formed by doubling over sections and are connected together through mutual engagement in the operational position.

14. A display and transportation container as claimed in claim 12, characterized in that the container is produced in a known manner from a single blank, the wall parts are formed by doubling over sections and are connected together through mutual engagement in the operational position.

15. A display and transportation case as claimed in claim 12, characterized in that the container is produced in a known manner from a single blank, the wall parts are formed by doubling over sections and are connected together through mutual engagement in the operational position.

16. A display and transportation container as claimed in claim 3, characterized in that the length of the first section is three times the length of a pack and the length of the second section is twelve times the thickness of a pack.

17. A display and transportation container as claimed in claim 8, wherein said transparent part includes a knee and is reinforced with lateral tongues or flaps at the knee.

* * * * *